US005842583A

United States Patent [19]

Kasa-Djukic

[11] Patent Number: 5,842,583

[45] Date of Patent: Dec. 1, 1998

[54] PAINTBRUSH HOLDER

[76] Inventor: Vladimir Kasa-Djukic, Werneckstrasse 31, Munich, Germany, 80802

[21] Appl. No.: 848,309

[22] Filed: Apr. 30, 1997

Related U.S. Application Data

[60] Provisional application No. 60/019,031 May 20, 1996.

[51] Int. Cl.[6] ..... A47F 7/00

[52] U.S. Cl. ..... 211/65

[58] Field of Search ..... 211/65, 120, 69.8, 211/89

[56] References Cited

U.S. PATENT DOCUMENTS

| | | | |
|---|---|---|---|
| 2,569,021 | 9/1951 | Rozanski | 211/120 |
| 4,223,791 | 9/1980 | Taggart | 211/120 |
| 5,421,466 | 6/1995 | Hsu | 211/120 |

*Primary Examiner*—Alvin C. Chin-Shue
*Assistant Examiner*—Sarah Purol
*Attorney, Agent, or Firm*—M. LuKacher; K. LuKacher

[57] ABSTRACT

A convenient, easily transportable holder for a large number of artists' paintbrushes of various sizes and diameters arranged for ready-access by the artists. The holder has a base of sheet metal with a top and sides which provides support for a spiral band along the top. The sides may be so dimensioned or angularly oriented with respect to the top so that the top is canted at an acute angle to the surface of a support of table on which the edges of the sides rest. The paintbrushes are held by friction fit because of the spring-like characteristics of the band between the turns of the spiral, notwithstanding that the brushes may be of different diameter. The artists may readily insert or remove one or more of the multiplicity of brushes for use while the others remain between the spiral turns of the band. The holder may have one side which defines with the top, a clip so that the holder is receivable over the edge of an artist's palette. A retaining rod holds the spring between the inside of the top and turns of the spring which project through angled slots cut into the top alignment with the spiral turns of the band.

9 Claims, 3 Drawing Sheets

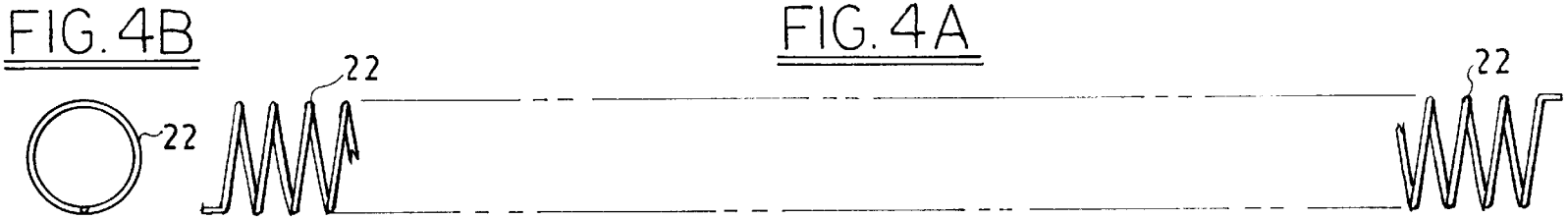
FIG. 4A
FIG. 4B
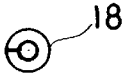
FIG. 5B
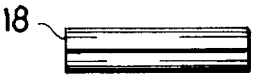
FIG. 5A
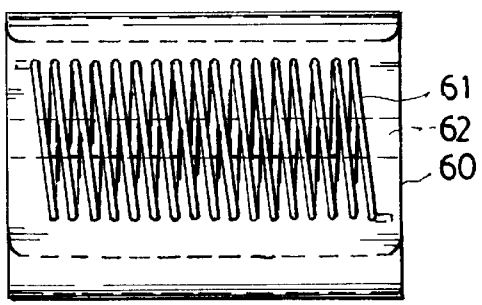
FIG. 6
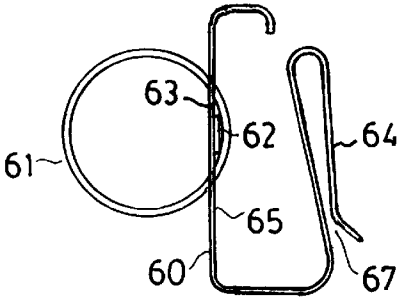
FIG. 7

PAINTBRUSH HOLDER

DESCRIPTION

The priority benefit is claimed of provisional application No. 60/019,031 filed May 20, 1996.

The present invention relates to a paint brush holder which carries a multiplicity of paintbrushes and presents them for pickup by the user. The invention provides a convenient easily transportable device that can hold a large number of artists' paintbrushes of various size and arranged for ready access by the artist.

To accomplish this end, a plate of this sheet material provides base having a top and sides. The base provides a support for a spiral band along the top. The sides are dimensioned or angularly oriented with respect to the top so that the top is canted an acute angle to the surface of a support or table on which the edges of the sides rest. Alternatively the plate may be bent into a clip which has spring characteristics and can be removably placed on a palette along an edge thereof. The paintbrushes are held with a friction fit because of the spring-like characteristics of the bank between the turns of the spiral. The turns of the spiral may be of varying pitch to facilitate holding brushes of different diameter. The artist may readily insert and remove one or more of a multiplicity of paintbrushes for use while other remain between the spiral turns of the band. The term "paintbrush" should be taken to mean other elongated devices, such writing implements and the like.

The invention will become more apparent from the drawings in which:

FIGS. 4 and 4A are plan and end views, respectively, of the spring band or wire which is used to hold the paintbrushes when assembled in the holder shown in FIGS. 1 to 3;

Figure 3:
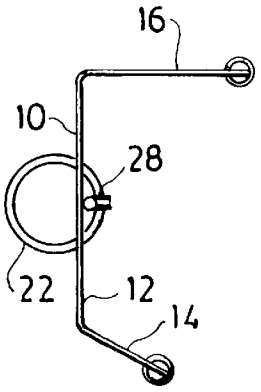
FIG. 3 is an end view of the paintbrush holder shown in FIG. 1.
Figure 1:
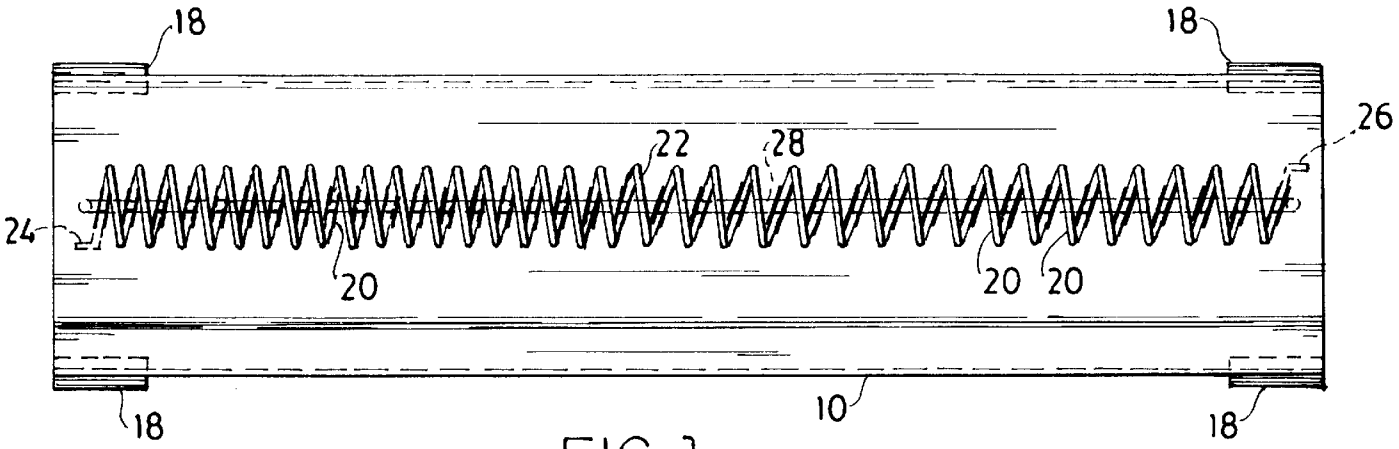
FIG. 1 is a plan view of a spring paintbrush holder embodying the invention.
Figure 2:
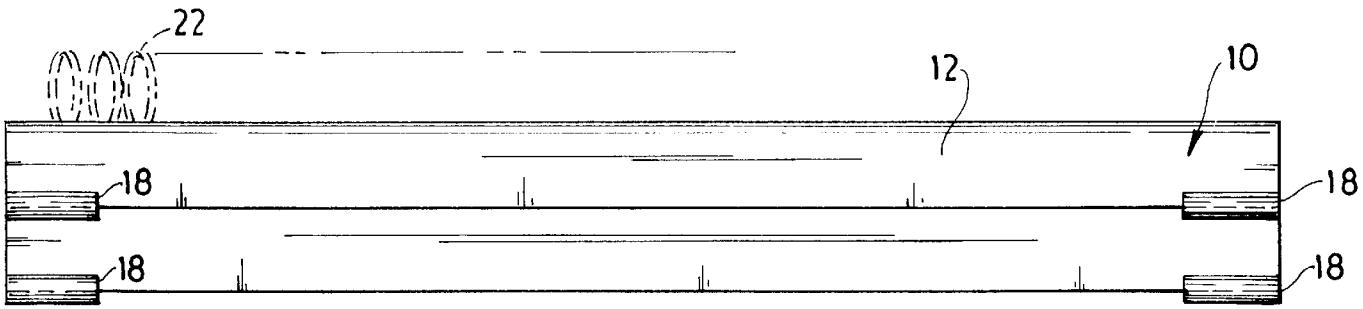
FIG. 2 is a front view from which the spiral band which holds the brushes between the turns thereof has been removed to simply the figure.
Figure 9:
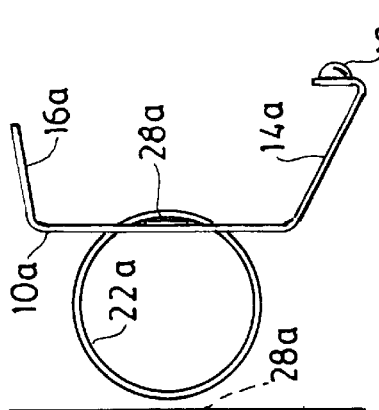
Figure 8:
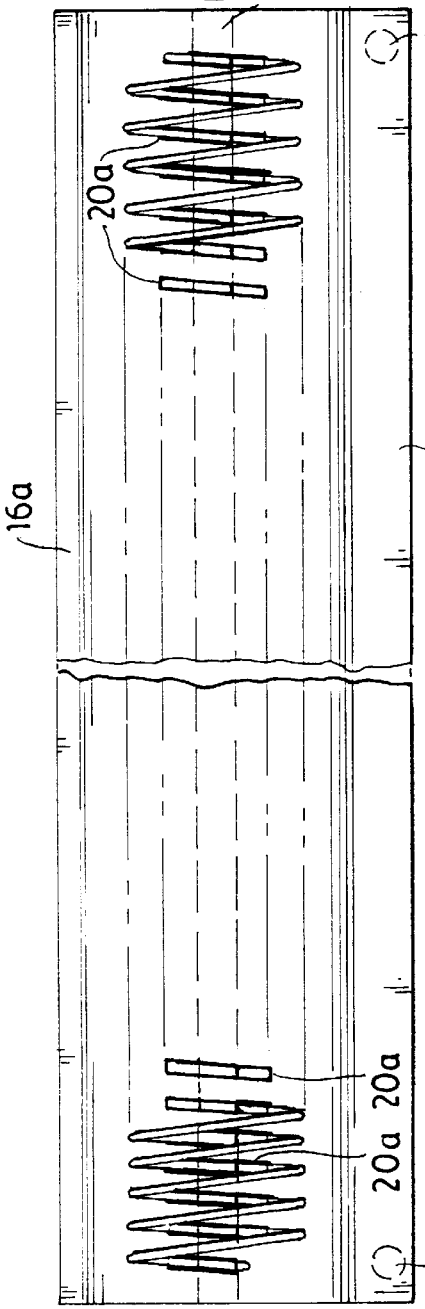
Figure 10:
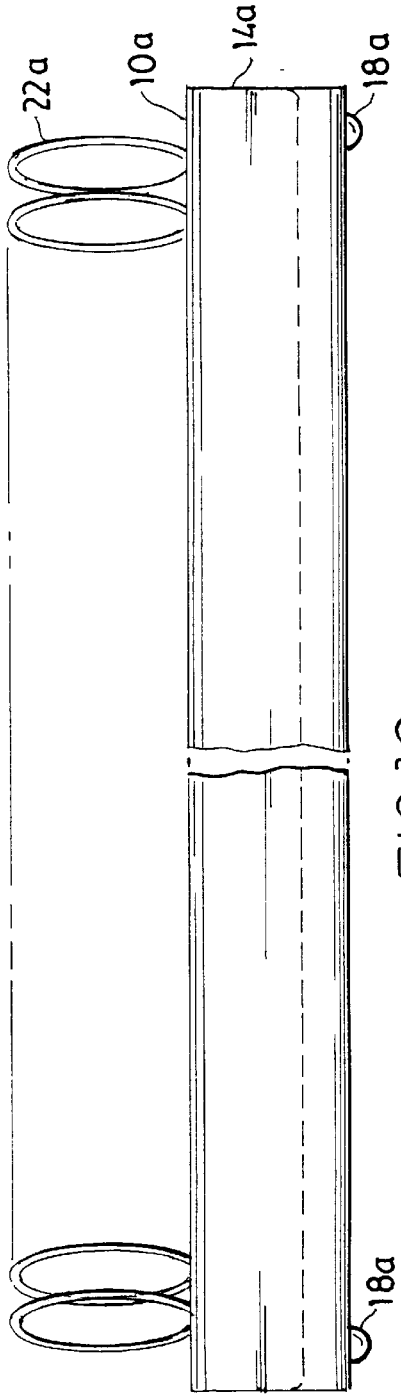

FIGS. 5A and B and front and end views of a typical foot of the four feet which are placed at the ends of the edges of the sides of the base in order to prevent marring of the surface on which the holder is disposed;

FIGS. 6 and 7 are front and end views of another embodiment of the holder which may be clipped to an artist's palette and the like; and FIGS. 8, 9 & 10 are views like FIGS. 1, 2 & 3 of another embodiment of the invention where the feet of the base have been modified in the intent of cost saving.

As shown in FIGS. 1–5, the base has a top 12 and front and rear legs 14 and 16 which are canted with respect to the top at such angles that when the edges of the bottom of the sides 14 and 16 are located on a support table surface, the top is canted at a desired angle, for example, 30° with respect to the surface of the table. Feet 18 of plastic material are tubes which are slit so as to hold by friction fit onto the edges of the sides 14 and 16. The feet 18 are best shown in FIGS. 5A and B.

The flaring or angular orientation with respect to the top 12 of the sides 14 and 16 and especially the side 14, facilitate stacking of the sides during manufacture.

The base thus provides a channel with one relatively long leg 16 and one short leg 14.

Angled slots 20 are cut into the top at angles corresponding to the angles between the spiral turns of a wire spring or band 22. In addition, two holes 24 and 26 are provided to permit safe and sightly termination of the brush holding spring 22 at axially bent ends thereof. These ends are inserted into the holes 24 and 26. The turns or coils of the spring 22 extend partially below the top 12 to an extent defined by the length of the slots 20 a sufficient distance to permit a spring retaining rod 28 that is slipped through the spring turns and protrudes on the inside of the top of the base. The ends of the rod 28 are bent after insertion through the turns of the spiral spring 22 to keep the rod 28 from slipping out of place.

As pointed out above, the feet 18 are split tubes which are either held by friction or bonded to the four comers of the base 10.

The slots 28 and the turns of the spring 22 may have different pitches (separation between turns) to accommodate brush handles of different diameters. The brush handles are placed between the turns with the brush ends facing downwardly or upwardly as desired and preferably free of and spaced from the top of the base 10.

As shown in FIG. 7 & 8, the holder may be used as a clip-on device, especially for an artist's palette. The holder's base 60 is like, the base 10, a plate of sheet metal or other similar relatively thin rigid material, having flexibility. A spiral, spring band 61 is fixed to top of the base in the slot 63 by means of a strip 62 of material of sufficient thickness to be interposed between the sectors of the turns of the band which extend through the top 65, so as to hold the band and the base 60 in assembled relationship. The friction fit between the strip 62 and the band 61 facilitates the attachment thereof. The side 64 is bent over the back of the top so as to define the clip 67 which holds the paintbrush holder on a palette with the band 61 facing the artist so as to present a multiplicity of paint brushes to the artist for use.

Referring to FIGS. 8, 9 & 10, similar parts are labeled with the same reference numeral as in FIGS. 1–3 but with "a" appended. The spiral band 20*a* is of larger diameter than the band 20. A strip 28*a* is used in place of the hold down rod 28. Instead of feet the edges of the side 14*a* is bent parallel to the top of the base 10*a* and buttons 15 preferably of plastic or to rubber as used.

Variations and modifications in the herein-described paintbrush holder, within the scope of the invention, will undoubtedly suggest themselves to those skilled in the art. Accordingly, the foregoing description should be taken as illustrative and not in a limiting sense.

I claim:

1. A holder for a multiplicity of paintbrushes which have handles, which holder comprises a plate of thin, rigid material defining a base, said base having at least one side and a top, a spiral band having a diameter and also having turns sufficiently spaced from each other to receive said handles in friction-fit relationship, notwithstanding that the handles can be of different diameter, a plurality of side-by-side slots in said top, said slots being in alignment with said turns, said slots being of a diameter less than the width of said band sufficient to receive, an elongated member between projections of said turns and the under side of said top thereby maintaining said band fixed to said top of said base.

2. The holder, according to claim 1, wherein said sides provide a front and a back of said base, said front and back having edges on which said base stands.

3. The holder, according to claim 2, further comprising feet on said edges, said feet being held in friction-fit relationship on said front and back of said base, along said edges.

4. The holder, according to claim 2, wherein one of said front and back is shorter than the other.

5. The holder, according to claim 2 wherein said front is bent at an angle of more than 90° to said top and said base is bent at an angle of about 90° to said top, so that said top is canted with respect to a surface on which said edges of said base are disposed.

6. The holder, according to claim 1, wherein said side is bent with respect to said top to form a clip for attachment of said holder over an edge of an artist's palette.

7. The holder, according to claim 1, wherein said turns of said band have varying pitch.

8. The holder, according to claim 2, wherein the edge of at least one of said front and back is folded to provide a surface generally paralleling said top, and buttons on said surface facing downwardly with respect to said top.

9. The holder according to claim 1 wherein said elongated member is a rod.

* * * * *